United States Patent [19]

Driesen et al.

[11] Patent Number: 4,922,733

[45] Date of Patent: May 8, 1990

[54] JIG FOR THE TREATMENT OF TEXTILE WEBS

[75] Inventors: Manfred Driesen; Dieter Itgenshorst, both of Krefeld, Fed. Rep. of Germany

[73] Assignee: Eduard Küsters Maschinenfabrik GmbH & Co. KG, Krefeld, Fed. Rep. of Germany

[21] Appl. No.: 326,462

[22] Filed: Mar. 20, 1989

Related U.S. Application Data

[63] Continuation of Ser. No. 158,335, Feb. 22, 1988, abandoned.

[30] Foreign Application Priority Data

Feb. 20, 1987 [DE] Fed. Rep. of Germany ..... 3705390

[51] Int. Cl.[5] ..... D06B 1/04

[52] U.S. Cl. ..... 68/205 R; 68/180

[58] Field of Search ..... 68/180, 200, 205 R, 68/207

[56] References Cited

U.S. PATENT DOCUMENTS

| | | | |
|---|---|---|---|
| 1,005,888 | 10/1911 | Rutler | 68/180 X |
| 2,271,874 | 2/1942 | Platt et al. | 68/180 X |
| 3,766,756 | 10/1973 | Farrar | 68/205 R X |

FOREIGN PATENT DOCUMENTS

| | | | |
|---|---|---|---|
| 0179353 | 10/1985 | European Pat. Off. . | |
| 3421152 | 12/1985 | Fed. Rep. of Germany . | |
| 1037560 | 9/1953 | France . | |
| 344587 | 3/1931 | United Kingdom | 68/205 R |
| 2037188 | 7/1980 | United Kingdom | 68/200 |

OTHER PUBLICATIONS

"Computer Abstracts of EP 179,353", Oct. 27, 1988.

*Primary Examiner*—Philip R. Coe

*Attorney, Agent, or Firm*—Kenyon & Kenyon

[57] ABSTRACT

A jig for the application of treatment liquor on a web of material comprises a reservoir tank formed to receive the total quantity of liquor required for application during at least one treatment pass of the web and an applicator system arranged inside the jig for proportioning the application of liquor onto the web, with the reservoir tank supplying the applicator system with treatment liquor.

4 Claims, 1 Drawing Sheet

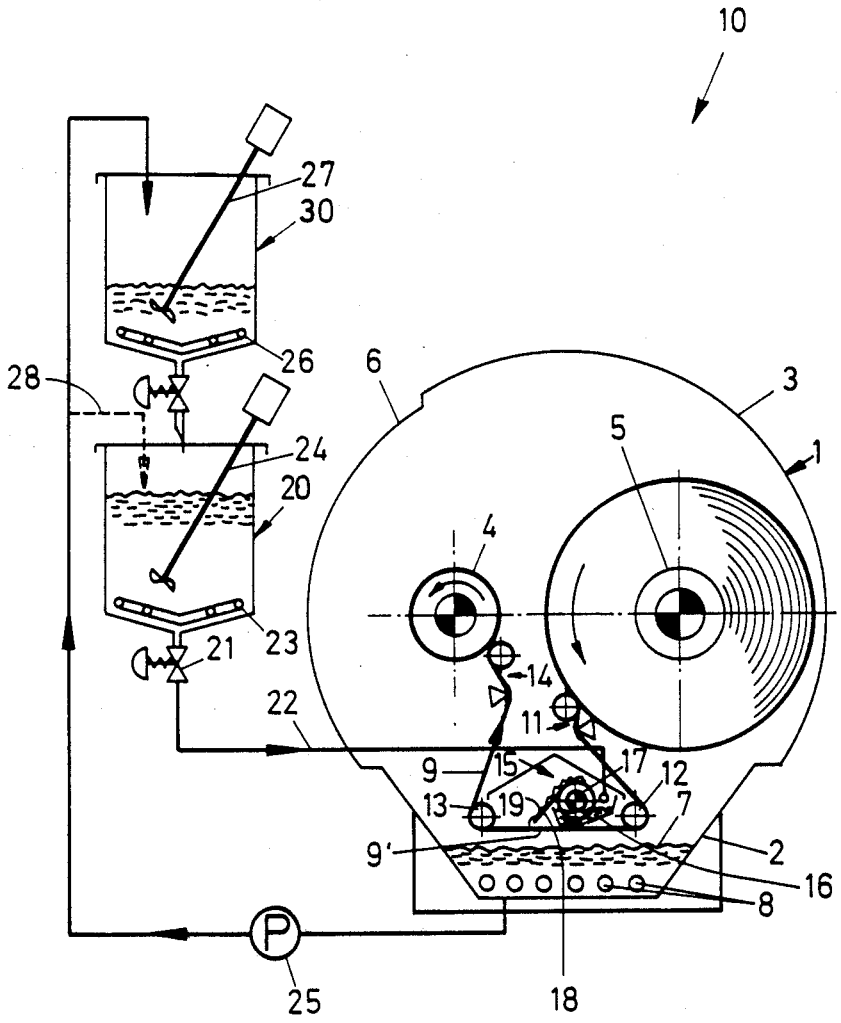
10
27
30
26
28
6
3
5
1
24
20
4
23
21
14
22
11
9
15
17
12
13
19
7
9'
2
16
8
P
25
18

JIG FOR THE TREATMENT OF TEXTILE WEBS

This application is a continuation of application Ser. No. 07/158,335, filed 2/22/88, and now abandoned.

BACKGROUND OF THE INVENTION

The invention relates generally to a jig for the treatment of a textile web and more particularly to jig with improved uniformity of application.

A jig having a housing with first and second housing portions, the first housing portion containing two mutually parallel winding rollers, a web of material to be treated mounted on the rollers, means defining a path along which the web can be reversibly wound back and forth onto the rollers, and with the second housing portion containing a liquid bath reserve is described in DE-OS 34 21 152. The disclosed jig also includes an applicator system uniformly applying a proportioned quantity of treatment liquor to the web as the web passes along a portion of the path disposed between the winding rollers above the level of the bath reserve in the second housing portion.

As further disclosed in DE-OS 34 21 152, the web of material in the jig housing runs along a path formed between two deflection rollers disposed below the winding rollers, which are approximately horizontally positioned in spaced relation above the level of the bath reserve in the jig housing. Between the deflection rollers a slitted discharge tube extending above and across the width of the web is arranged from which treatment liquor is discharged onto the web as it slides past the discharge slit. The treatment liquor is supplied from the bath reserve contained in the lower part of the jib housing. The liquor, in part, drips back from the web into the bath reserve, and in this manner is continuously circulated within the jig in a predetermined proportion.

One of the problems with jigs of this type is that the beginning of the web is treated with a bath having a higher concentration than and different consistency from the bath present at the end of the web. Treatment liquor that had been in contact with the web via the discharge slit drips into the lower portion of the jig in the aforementioned manner. However, since some of the treatment agents such as dyes, acids, salts, oxidants, soaps, fastness improvers, etc., have been absorbed by the web, liquor dripping from the web is in a diluted condition and thereby changes the overall consistency of the liquid in the bath reserve. Since this liquid is ultimately applied to the web at the end of the web treatment process, the result is nonuniform application of the treatment liquor.

Another problem encountered in conventional jigs is the alteration of the bath consistency which occurs during passage of the web through the bath reserve contained in the vat-like lower portion of the jib. This produces nonuniform liquor application not only due to the alteration of the bath consistency, but also due to the attendant accidental changes in the absorption capacity of the web over its surface area.

Previous solutions to these problems have been unsatisfactory. One such solution is known from FR-PS 1,037,560 which discloses continuously pumping off the liquid contained in the vat-like lower portion and reapportioning the liquid reintroduced into the jib. This solution involves considerable cost and does not solve the problem of nonuniform distribution of the reproportioned liquid caused by passage of the web through the bath reserve.

A prior solution to the problem of variation in bath supply consistency during a single web pass, i.e., when the entire web length completely passes from one winding roller to the other, the earlier jig systems was to approximately even out the conditions in the web by repeatedly winding the web back and forth between the winding rollers.

This solution greatly multiplies the cost of treatment because of the large number of successively performed processes carried out in the jig that must be repeated. For example, the succession of treatment steps may be desizing—rinsing; boiling off—rinsing; bleaching—rinsing; and dye application with the addition of additives and/or developers, etc. These discrete processes are all divided into several passes, and in all of them repeated draining of the treatment baths and respective reheating is necessary. Treatment times of 4 to 6 hours are not unusual.

Another problem with prior jigs is maintenance of the important ratio of bath to web area when the jig is subject to different loads. For the jig to function properly, a certain minimum content of bath is needed. The bath supply must be matched with different total surface areas of the webs treated in the jig, i.e., the same amount of bath is used to treat, on the one hand, wide as well as narrow webs of equal length and, on the other hand, shorter and longer webs. This makes it difficult to keep the treatment result uniform and requires checking by expensive interim sampling.

All of the above-noted problems result in undesirable nonuniform treatment of the web.

SUMMARY OF THE INVENTION

The uniformity problems of prior jigs are avoided and a more uniform web treatment achieved by the improved jig of the present invention.

The improved jig achieves more uniform web treatment by provision of a reservoir tank for the applicator system which contains enough treatment liquor for at least one pass of the web from one winding roller to the other, i.e., an amount of liquid sufficient for treating the entire length of web once. Compared to prior jigs where the lower part of the jig was the reservoir from which treatment liquor was recirculated, the reservoir tank of the present invention is separate and does not contain treatment liquor which was in contact with the web during that pass. The web cannot contact the treatment liquor in the reservoir tank and draw from it; this liquid is supplied only to the applicator. In particular, the reservoir tank is separate from the lower portion of the jig where conditions of the bath change during a treatment pass. Each unit area of the web receives an exactly proportioned amount of liquor required for treatment. The treatment is uniform because the liquor is supplied from the separate reservoir tank which has the same concentration and other properties at the beginning and at end of each web treatment pass.

The reservoir tank may be dimensioned large enough such that its volume is sufficient for carrying out several web treatment passes. It is not necessary that the treatment liquor be of the same consistency for two successive passes. The only determining factor is that during one web treatment pass the total liquor amount can be supplied from the reservoir tank and that the quality or consistency of the liquor applied to the beginning of the web is the same as the liquor applied to the end.

The impoved jig obviates the need for repeated moving back and forth of the web to achieve the required uniformity of treatment and makes it relatively easy to adjust the quantity of bath applied to the total web surface area and to the absorption characteristics of the web.

The reservoir tank may be disposed inside the jig housing for easier control of temperature variations, but also may be disposed outside the jig housing when space considerations and similar concerns dominate.

Additionally, the reservoir tank may be controllably connected to a secondary tank which receives liquid from the bath reserve as it is continuously pumped from the lower jig housing portion. This ensures that the bath level in the jig will not rise too high and contact the web. Additionally, it enables the bath reserve to be reprocessed or newly prepared and then transferred to the reservoir tank in the requisite quantity for application to the web.

BRIEF DESCRIPTION OF THE DRAWINGS

The sole drawing FIGURE is a schematic cross sectional view of a jig constructed according to the principles of the invention.

DETAILED DESCRIPTION

In the illustrated embodiment the jig, generally designated at 10, comprises a housing 1 with a vat-like bottom portion 2 and a top portion 3, which can be opened at 6 to permit access to the winding rollers 4, 5 driven in mutual dependence. Bath dripping from web 9, which may be cloth or other suitable material, collects in the vat-like bottom portion 2 and rises to a given level 7. This bath reserve is temperature controlled by heaters 8.

The drawing FIG. shows the beginning of the rewinding of the web from winding roller 5 to winding roller 4. A path formed from which the web 9 passes from roller 5 to roller 4 includes tensioning device 11, two deflection rollers 12, 13 located at approximately the same horizontal level in spaced relation above the bath reserve level 7, and a further tensioning device 14.

An application system, generally designated as 15, is disposed above the approximately horizontal section 9' of the web between the deflection rollers 12 and 13. The applicator system consists of: a trough 16 containing a bath of treatment liquor 19, with the trough extending across the width of the cloth web; a revolving roller 17 having its lower portion immersed in liquor 19; and a drain plate 18. The upper edge of the applicator bears against the roller 17 in a manner similar to that of a doctor blade thereby removing a quantity of liquor 19 from the surface of roller 17. The removed quantity flows from the lower edge of the drain plate 18 down onto the web section 9'. The quantity of liquor transferred per unit area onto the web section 9' can be regulated precisely through appropriate adjustment of the bath level in the trough 16 and the rotational speed of the roller 17.

The liquor in trough 16 is replenished from a reservoir tank 20 which is arranged outside the housing 1 in a position above trough 16. From reservoir 20 the liquor is supplied to trough 16 via a proportioning valve 21 and a conduit 22. The liquor temperature in trough 16 is controlled by heaters 23. The bath is continuously circulated inside the reservoir tank 20 by an agitator 24 to maintain a uniform concentration.

The quantity of bath contained in the reservoir tank 20 is great enough such that the entire web length contained in jig 10 (all of which is shown as being wound on the winding roller 5 at the moment illustrated in the drawing) can be treated with liquor during at least one pass of the web from roller 5 to roller 4. The liquor is drawn uniformly from the reservoir tank 20 into trough 16 during the entire pass and remains uniform in quality and consistency.

Above the reservoir tank 20 there may be provided a secondary tank 30, of approximately the same size as reservoir 20, into which the bath contained in vat-like lower housing portion 2 may be continuously drawn off by means of a pump 25. This ensures that bath level 7 remains constant during treatment to prevent contact with web 9' and provides a means by which the vat-like bottom portion can be evacuated at the end of a treatment pass. The secondary tank 30 also is provided with heaters 26 and an agitator 27. It is thus possible to transfer the entire quantity of bath contained in the bottom portion 2 into the secondary tank 30. After make-up fluid is added to ensure that the required web treating quantity is present in tank 30 and/or reproportioning occurs after completion of a web treating pass, the fluid in tank 30 may be delivered into the reservoir tank 20 thereby presenting a bath quantity sufficient for another treatment pass. Although the liquor may be of a different type or quality than the type previously applied to web 9, it remains uniform with respect to its properties during the second web pass.

It is also possible to operate without provision of the secondary tank 30 if care is taken via appropriate proportioning of the liquor quantity to ensure that during treatment the liquid level 7 in the lower portion 2 does not rise too high and contact web portion 9'. With such an arrangement, after the treatment pass the liquid contained in the lower portion 2 is pumped back into the reservoir tank 20 directly by the pump 25, as is indicated by the dashed branch line 28. The replenishment with make-up fluid and reproportioning of the liquid quantity may then take place in the reservoir tank 20. Since during this processing time the jig 10 cannot continue to operate, use of the reservoir tank in conjunction with a secondary tank is more economical and versatile.

What is claimed is:

1. A jig for the treatment of a textile web comprising;

(a) a housing having first and second portions;

(b) two mutually parallel winding rollers disposed in said first housing portion;

(c) a web of material to be treated mounted on the rollers;

(d) means defining a path along which the web can be reversibly wound back and forth onto said rollers;

(e) a bath disposed within said second housing portion;

(f) an applicator system uniformly applying a proportioned quantity of treatment liquor to the web as the web passes along a portion of said path disposed within said housing between the winding rollers above the level of said bath in said second housing portion;

(g) a reservoir tank supplying the applicator system with treatment liquor, said reservoir tank being of sufficient size to contain the total quantity of treatment liquor necessary for at least one treatment pass of the web; and (h) means for pumping the bath into the reservoir tank only after said at least one treatment pass of the web is completed whereby the total quantity of treatment liquor is maintained separate from said bath for at least one treatment pass of the web.

2. A jig for the treatment of a textile web comprising;

(a) a housing having first and second portions;

(b) two mutually parallel winding rollers disposed in said first housing portion;

(c) a web of material to be treated mounted on the rollers;

(d) means defining a path along which the web can be reversibly wound back and forth onto said rollers;

(e) a bath disposed within said second housing portion;

(f) an applicator system uniformly applying a proportioned quantity of treatment liquor to the web as the web passes along a portion of said path disposed within said housing between the winding rollers above the level of said bath in said second housing portion;

(g) a reservoir tank supplying the applicator system with treatment liquor, said reservoir tank being of sufficient size to contain the total quantity of treatment liquor necessary for at least one treatment pass of the web;

(h) a secondary tank of sufficient size to have a capacity at least as large as the reservoir tank, (i) a pump connected between said second housing portion and said secondary tank delivering liquid from said bath into said secondary tank; and (j) a controllable connection between said secondary tank and said reservoir tank whereby liquid from said bath may be delivered into said reservoir tank and the total quantity of treatment liquor is maintained separate from said bath for at least one treatment pass of the web.

3. A jig according to claim 2, wherein the reservoir tank is disposed outside the housing.

4. A jig according to claim 1, wherein the reservoir tank is disposed outside the housing.

* * * * *